US010068727B2

(12) United States Patent
Chang et al.

(10) Patent No.: US 10,068,727 B2
(45) Date of Patent: Sep. 4, 2018

(54) KEY SURFACE LIGHTING

(71) Applicant: Apple Inc., Cupertino, CA (US)

(72) Inventors: Ray L. Chang, Cupertino, CA (US); Robert M. Proie, Jr., Cupertino, CA (US)

(73) Assignee: Apple Inc., Cupertino, CA (US)

( * ) Notice: Subject to any disclaimer, the term of this patent is extended or adjusted under 35 U.S.C. 154(b) by 340 days.

(21) Appl. No.: 14/817,316

(22) Filed: Aug. 4, 2015

(65) Prior Publication Data

US 2017/0040127 A1 Feb. 9, 2017

(51) Int. Cl.
*H01H 13/83* (2006.01)
*F21V 23/06* (2006.01)

(52) U.S. Cl.
CPC ..... *H01H 13/83* (2013.01); *H01H 2219/037* (2013.01)

(58) Field of Classification Search
CPC ..... G06F 3/0202; H01H 13/83; H01H 13/84; F21V 23/06
See application file for complete search history.

(56) References Cited

U.S. PATENT DOCUMENTS 5,278,371 A 1/1994 Watanabe et al.
5,619,005 A 4/1997 Shibukawa et al.
5,742,242 A 4/1998 Sellers
5,745,376 A 4/1998 Barker et al.
5,746,308 A 5/1998 Lin
5,960,942 A 10/1999 Thornton
5,986,227 A 11/1999 Hon
5,997,196 A 12/1999 Hu
6,040,540 A 3/2000 Tsai et al.
6,229,684 B1 5/2001 Cowen et al.
(Continued)

FOREIGN PATENT DOCUMENTS

CN 102280292 12/2011
JP 2007-519317 7/2007
(Continued)

OTHER PUBLICATIONS

U.S. Appl. No. 13/407,910, filed Feb. 29, 2012, Niu et al.
(Continued)

*Primary Examiner* — Karabi Guharay
(74) *Attorney, Agent, or Firm* — Brownstein Hyatt Farber Schreck, LLP

(57) ABSTRACT

An illuminator may be coupled to the key cap of a key. The key cap may include a portion that is operable to be illuminated and one or more illuminators may be coupled thereto. In particular embodiments, keys may include power delivery systems that are operable to wirelessly transmit power from a power source to illuminators. Such power delivery systems can include inductive transmitters and/or receivers, ultrasonic transmitters and/or receivers, laser diodes and photodiodes, electrodes that capacitively couple to wirelessly transfer power, and so on. In various embodiments, keys may include interconnects that connect an illuminator with a power source. The interconnect may be a flexible material that includes one or more traces and is configured with a shape that bends and twists to allow movement without stretching. The interconnect may also be part of a movement or support mechanism of a key.

17 Claims, 11 Drawing Sheets

(56) References Cited

U.S. PATENT DOCUMENTS

| | | | |
|---|---|---|---|
| 6,351,205 | B1 | 2/2002 | Armstrong |
| 6,648,530 | B2 | 11/2003 | Kamei et al. |
| 6,802,016 | B2 | 10/2004 | Liu |
| 6,990,867 | B2 | 1/2006 | Okada |
| 7,239,303 | B2 | 7/2007 | Liao et al. |
| 7,460,050 | B2 | 12/2008 | Alvarado et al. |
| 7,842,895 | B2 | 11/2010 | Lee |
| 7,880,247 | B2 | 2/2011 | Vaganov et al. |
| 7,903,166 | B2 | 3/2011 | Daly |
| 8,110,764 | B2 | 2/2012 | Hsu et al. |
| 8,207,872 | B2 | 6/2012 | Huang et al. |
| 8,446,264 | B2 | 5/2013 | Tanase |
| 8,912,458 | B2 | 12/2014 | Peterson et al. |
| 8,957,337 | B2 | 2/2015 | Niu et al. |
| 8,981,243 | B2 | 3/2015 | Leong et al. |
| 9,093,229 | B2 | 7/2015 | Leong et al. |
| 2006/0181511 | A1 | 8/2006 | Woolley et al. |
| 2007/0200823 | A1 | 8/2007 | Bytheway et al. |
| 2010/0108486 | A1 | 5/2010 | Yoshida |
| 2011/0155552 | A1 | 6/2011 | Wang |
| 2011/0260978 | A1 | 10/2011 | Larsen |
| 2012/0091794 | A1 | 4/2012 | Campanella et al. |
| 2013/0161172 | A1 | 6/2013 | Leong et al. |
| 2014/0118264 | A1* | 5/2014 | Leong ..... G06F 3/0202 345/168 |
| 2014/0126176 | A1* | 5/2014 | Yao ..... G02B 6/006 362/23.03 |
| 2014/0176352 | A1 | 6/2014 | Hussain et al. |
| 2015/0022995 | A1 | 1/2015 | Peterson et al. |
| 2015/0061901 | A1 | 3/2015 | Casparian et al. |

FOREIGN PATENT DOCUMENTS

| | | |
|---|---|---|
| JP | 2007-532069 | 11/2007 |
| WO | WO 99/024962 | 5/1999 |
| WO | WO 10/095075 | 8/2010 |
| WO | WO 11/000910 | 1/2011 |
| WO | WO 11/152826 | 12/2016 |

OTHER PUBLICATIONS

U.S. Appl. No. 13/722,993, filed Dec. 20, 2012, Leong et al.
U.S. Appl. No. 13/723,033, filed Dec. 20, 2012, Leong et al.
U.S. Appl. No. 13/723,054, filed Dec. 20, 2012, Leong et al.

* cited by examiner

KEY SURFACE LIGHTING

FIELD

The described embodiments relate generally to lighting. More particularly, the present embodiments relate to providing power to surface mounted lights on keyboard keys.

BACKGROUND

Many electronic devices include illuminated surfaces. For example, some keyboards illuminate keys so that the keyboard can be used in low or no lighting conditions. Additionally, keys may be illuminated simply to aid users in understanding the functions associated with various keys, such as by illuminating a legend on a surface of a key.

This surface lighting is generally implemented by mounting a light emitting diode (LED) on a printed circuit board (and/or flexible circuits and/or wires connected thereto) under a key. Due to this placement, light guide panels and/or other structures are often used in order to distribute light from the LED evenly as well as prevent or reduce "hot spots" (areas of comparative brightness corresponding to the actual location of an LED).

Such light guide panels or other structures occupy space in a key stack, making key stack dimensions larger than they otherwise would be and/or limiting the components that could otherwise be included. Further, even with such light guide panels or other structures, greater amounts of power may be provided to an LED than would otherwise be used with the LED alone in order to obtain a desired illumination level due to the position of the LED or other structures, distance from the key cap, the diffusion of light, and so on.

SUMMARY

The present disclosure relates to surface illumination. One or more illuminators may be coupled to the key cap of a key. Additionally, a key cap may include a portion that is operable to be illuminated and one or more illuminators may be coupled to that portion. These techniques may enable distribution of illumination without light guides and/or other structures and may prevent other key stack structures from interfering with light distribution.

In particular embodiments, key stacks may include power delivery systems that are operable to wirelessly transmit power from a power source to illuminators coupled to the key caps. Such power delivery systems can include inductive transmitters and/or receivers, ultrasonic transmitters and/or receivers, laser diodes and photodiodes, electrodes that capacitively couple to wirelessly transfer power, and so on. In various embodiments, key stacks of keys may include interconnects that connect illuminators coupled to the key caps with power sources. In some implementations, the interconnect may be a flexible material that includes one or more traces and is configured with a shape that bends and twists to allow movement of the key cap without stretching. In various implementations, the interconnect may be part of a movement or support mechanism of a key, such as where a support mechanism includes a conductive moveable strut that connects the illuminator and power source or where the support mechanism is a fabric web in which the key cap is mounted and the interconnect is one or more traces disposed thereon.

In various embodiments, a keyboard may include a printed circuit board and a number of keys coupled to the printed circuit board. Each key may include an actuator, a movement mechanism coupled to the actuator that biases the actuator towards an un-depressed position and allows movement of the actuator towards a depressed position to activate the respective key, a light emitting diode coupled to the actuator, and a power receiver coupled to the light emitting diode that is operable to provide power wirelessly received from the printed circuit board to the light emitting diode.

In some examples, the power receiver may be at least one of an inductive receiver, an ultrasonic receiver, a photodiode, or a first electrode that wirelessly receives power by capacitively coupling to a second electrode.

In various examples, the actuator may include a first region that is operable to be illuminated and a second region that is not operable to be illuminated and the light emitting diode may be coupled to the first region. In some examples, the light emitting diode may be multiple light emitting diodes coupled to the first region.

In some embodiments, a key stack may include a substrate having a switch and a power conduit, a key cap disposed above the switch, a support mechanism moveably coupling the key cap to the substrate and configured to move the key cap into a depressed position to actuate the switch, an illuminator coupled to the key cap, and a power delivery system operable to wirelessly transmit power from the power conduit to the illuminator.

In various examples, the power delivery system may be an inductive receiver coupled to the illuminator and operable to inductively receive power from an inductive transmitter. In some examples, the power delivery system may be a first electrode coupled to the illuminator and operable to capacitively couple to a second electrode to wirelessly receive power from the second electrode. In various examples, the power delivery system may be an ultrasonic receiver coupled to the illuminator and operable to convert an ultrasonic signal received from an ultrasonic transmitter into power for the illuminator. In some examples, the power delivery system may be a photodiode coupled to the illuminator and configured to convert light received from a laser diode into power for the illuminator.

In some examples, the key stack may further include a storage capacitor coupled to the illuminator that is operable to store power received from the power delivery system and provide stored power to the illuminator.

In various examples, the illuminator may be at least one of coupled to a surface of the key cap or embedded at least partially within the key cap. In some examples, the illuminator may be at least one of a light emitting diode or an organic light emitting diode.

In one or more embodiments, a key stack may include a key cap, a support mechanism coupled to the key cap that allows movement of the key cap, an illuminator coupled to the key cap, and an interconnect coupled to the illuminator and a power source that provides power from the power source to the illuminator.

In various examples, the interconnect may be a flexible material (such as a polymer) including a trace, the flexible material configured with a shape (such as at least one of a zigzag shape, a serpentine shape, and a spiral) that bends and twists when the key cap moves between a depressed position and an un-depressed position.

In some examples, the support mechanism may be a fabric web. In such examples, the interconnect may be a trace formed on the fabric web. In various examples, the support mechanism may be multiple moveable struts and the interconnect may be a conductive strut of the multiple moveable struts.

In various examples, the key cap may include a transparent region and an opaque region. In such examples, the illuminator may be coupled to the transparent region.

BRIEF DESCRIPTION OF THE DRAWINGS

The disclosure will be readily understood by the following detailed description in conjunction with the accompanying drawings, wherein like reference numerals designate like structural elements.

FIGS. 3-5A show cross-sectional views of additional examples of key stacks that use wireless power delivery systems for illumination in accordance with further embodiments of the present disclosure.

DETAILED DESCRIPTION

Figure 1:
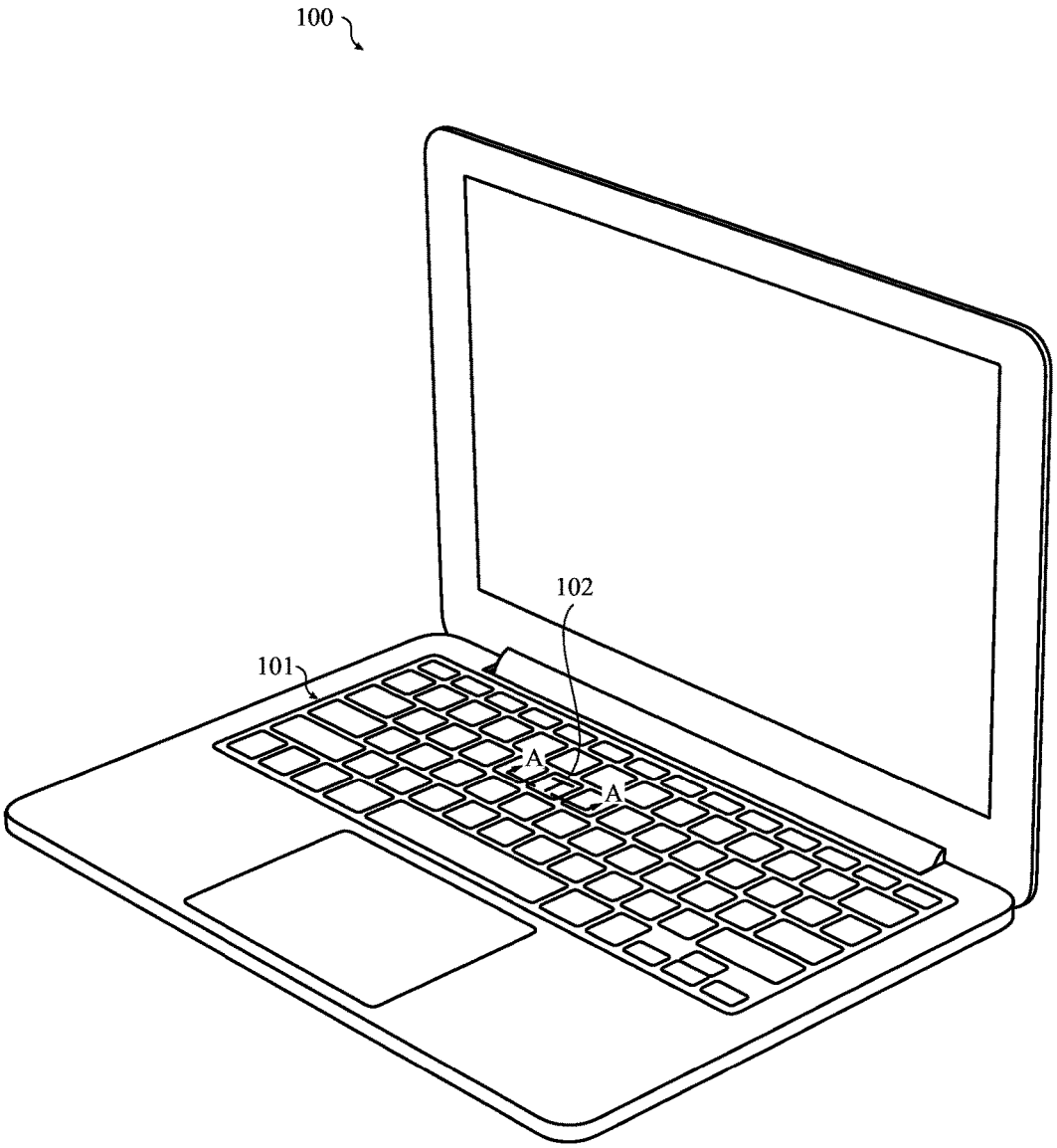
FIG. 1 shows a computing device including a keyboard.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The description that follows includes sample systems, methods, and apparatuses that embody various elements of the present disclosure. However, it should be understood that the described disclosure may be practiced in a variety of forms in addition to those described herein.

The following disclosure relates to surface illumination, such as illuminating the keys or other actuators of a keyboard. One or more LEDs and/or other illuminators may be coupled to the key cap of a key. This may enable distribution of illumination without light guides and/or other structures, though such may still be used in some implementations, and may prevent other key stack structures (such as movement mechanisms) from interfering with light distribution. Additionally, a key cap may include a portion that is operable to be illuminated and one or more LEDs may be coupled to that portion, further enabling distribution of illumination without light guides and/or other structures.

In particular embodiments, key stacks of keys may include power delivery systems that are operable to wirelessly transmit power from a power source (such as a power conduit located on a printed circuit board to which the key is movably mounted) to LEDs coupled to the key caps. Such power delivery systems can include inductive transmitters and/or receivers, ultrasonic transmitters and/or receivers, laser diodes and photodiodes, electrodes that capacitively couple to wirelessly transfer power, and so on. In some implementations, the LED may be coupled to a capacitor and/or other power storage such that the LED may be operable to illuminate even when power is not currently being wirelessly transmitted.

In various embodiments, key stacks of keys may include interconnects that connect LEDs coupled to the key caps with power sources. In some implementations, the interconnect may be a flexible material (such as a polymer, elastomer, and so on) that includes one or more traces and is configured with a shape (such as a zigzag shape, a serpentine shape, a spiral, and so on) that bends and twists to allow movement of the key cap without stretching. In various implementations, the interconnect may be part of a movement or support mechanism of a key, such as where a support mechanism includes a conductive moveable strut that connects the LED and power source or where the support mechanism is a fabric web in which the key cap is mounted and the interconnect is one or more traces disposed thereon.

These and other embodiments are discussed below with reference to FIGS. 1-12. However, those skilled in the art will readily appreciate that the detailed description given herein with respect to these Figures is for explanatory purposes only and should not be construed as limiting.

FIG. 1 shows an isometric view of a computing device 100 including a keyboard 101 having a number of keys 102 that may have one or more LEDs and/or other illuminators coupled to key caps or other actuators of the keys 102. As described with respect to FIGS. 2-12 below, the LEDs may be powered via one or more wired or wireless power delivery systems.

The keys 102 may include one or more legends, such as one or more characters, symbols, and so on. Such legends may indicate one or more functionalities associated with the keys 102. For simplicity, only the "T" legend is shown.

Figure 2:
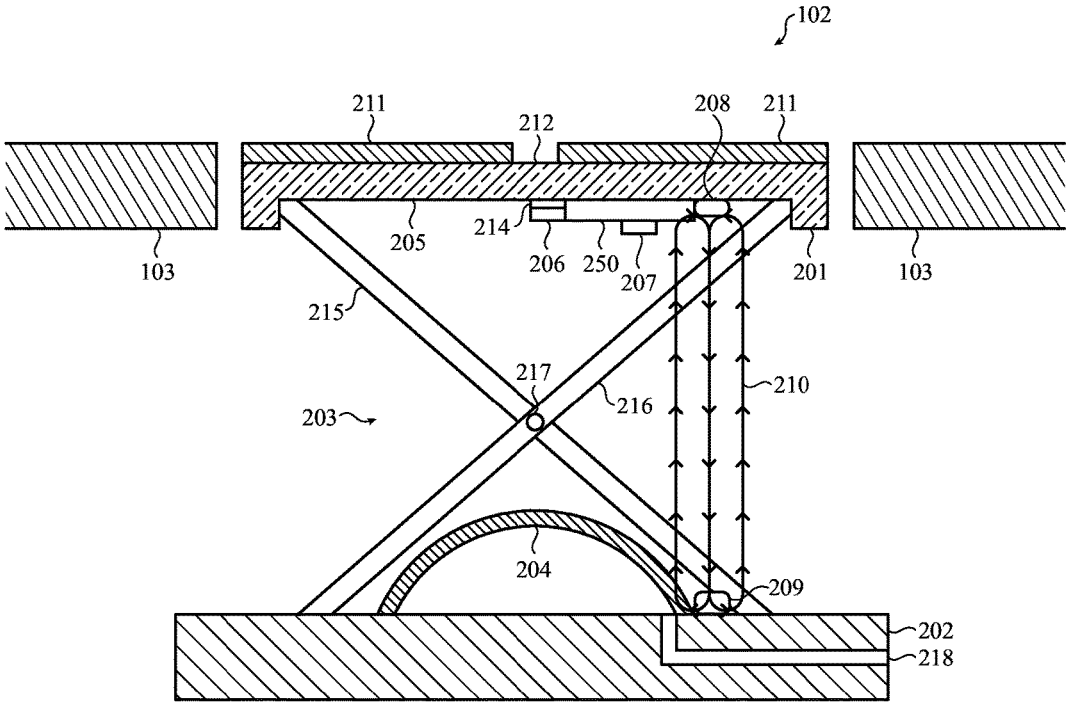
FIG. 2 shows a cross-sectional view of an example key stack of the keyboard of FIG. 1 that uses wireless power delivery system for illumination, taken along A-A of FIG. 1.

FIG. 2 shows a cross-sectional view of an example key stack of the keyboard 101 of FIG. 1 that uses wireless power delivery system for illumination, taken along A-A of FIG. 1. A key 102 may include a key cap 201 (or other actuator) with one or more illuminators 206 coupled thereto (such as an LED, which may be an organic LED or OLED, and/or any other illuminator such as an incandescent bulb, an electroluminescent material or device, a quantum dot, a laser, and so on). This may enable distribution of illumination without light guides and/or other structures. As shown, the illuminator may be coupled to an underside surface 205 of the key cap 201.

The key 102 may include a power delivery system that wirelessly delivers power from a power conduit 218 of a printed circuit board 202 or other substrate to the illuminator 206. The power delivery system may include a power transmitter 209 that is operable to wirelessly transmit power from the power conduit 218 to a power receiver 208, which may be coupled to the illuminator 206. In this example, the power delivery system includes an inductive transmitter 209 that is operable to induce a current in an inductive receiver 208 by creating a magnetic field 210. This may inductively transmit power from the power conduit 218 to the illuminator 206.

In some implementations, the key 102 may further include a controller 250, which may be coupled between the inductive receiver 208 and the illuminator 206. The controller 250 may be operable to control the illuminator 206 to perform one or more various different illumination effects.

In some examples, the controller 250 may be a simple controller capable of receiving instructions to drive the illuminator 206 to perform a limited set of illumination effects in order to minimize power utilized by the controller 250. However, in other examples the controller 250 may be a more complex (possibly still a low power complex controller) that is operable to receive instructions to drive the illuminator 206 to perform a less limited set of illumination effects.

For example, in some implementations, the illuminator 206 may be an OLED assembly and the controller 250 may be an OLED controller. The OLED controller may be operable to receive instructions to drive individual OLED elements of the OLED assembly, perform a dithering effect using the OLED assembly, control brightness levels of the OLED assembly, and/or various other illumination effects.

In some implementations, the data specifying how the controller 250 is to control the illuminator 206 may be received by the controller 250 in a variety of ways. For example, the data may be embedded in the power transmission received by the power receiver 208. In some cases of such an example, the data may be embedded in the power transmission at a different carrier frequency than the power.

By way of another example, the data specifying how the controller 250 is to control the illuminator 206 may be received by the controller 250 via a separate path than the power transmission received by the power receiver 208. Such a separate path may be a wired communication path such as a flex circuit, a wireless communication path such as an infrared transmission system, and/or various other communication paths.

In various implementations, the data specifying how the controller 250 is to control the illuminator 206 may be transmitted to the controller 250 by one or more processing units, such as a processing unit of the computing device 100 or a processing unit of another computing device. Such data may be transmitted at the instruction of one or more operating systems, applications, in response to user input, and so on.

The power delivery system in this example may also include a storage capacitor 207 or other power storage component coupled between the inductive receiver 208 and the illuminator 206 (such as via the controller 250). The storage capacitor 207 may receive and store power from the inductive receiver 208. The storage capacitor 207 may also provide stored power to the illuminator 206. In this way, the illuminator 206 may be operable to illuminate even when power is not currently being wirelessly transmitted.

The key cap 201 may include a first region 212 that is operable to be illuminated by the illuminator 206 and a second region 211 that is not operable to be illuminated. The illuminator 206 may be coupled to the first region 212, further enabling distribution of illumination without light guides and/or other structures.

The first region 212 may be a transparent or translucent region and the second region 211 may be an opaque region. In this example, the key cap 201 may itself be transparent and portions thereof may be coated with an opaque coating. Thus, the first region 212 may be the portions of the key cap 201 not coated with the opaque coating and the second region 211 may be the portions of the key cap 201 coated with the opaque coating.

As shown, a cover 214 may be positioned over the illuminator 206. The cover 214 may block direct passage of illumination from the illuminator 206 through the first region 212, preventing a hot spot at the location of the illuminator 206. Instead, illumination from illuminator 206 may shine out from under the cover 214 and then illuminate the first region 212. However, in other implementations the cover 214 may not be used. In still other implementations, a light guide and/or other structure may be utilized with the illuminator 206 instead of and/or in addition to a cover 214.

The key cap 201 may be positioned within an aperture in a top plate 103 and mounted to the printed circuit board 202 via a movement mechanism 203 or other support mechanism. The movement mechanism 203 may allow movement of the key cap 201 to move between an un-depressed position (shown) and a depressed position where the key cap 201 may compress or otherwise activate a dome switch 204 or other switch. As shown, the movement mechanism 203 may be a "scissor" mechanism formed by moveable struts 215 and 216 connected via a spring hinge 217. This may bias the key cap 201 is towards the un-depressed position but allow movement toward the dome switch 204 to transition the key 102 to a depressed position and activate the key 102.

Although the key 102 is shown with a scissor type movement mechanism 203, it should be understood that this is an example and that other movement mechanisms 203 are possible without departing from the scope of the present disclosure. For example, a "butterfly" mechanism may include two flaps joined by a hinge. Such a butterfly mechanism may allow transition of the key cap 201 from an un-depressed position to a depressed position by the flaps moving on the hinge to widen an angle formed by the flaps. Similarly, the flaps moving on the hinge to narrow the angle formed by the flaps may transition the key cap 201 from the depressed position to the un-depressed position.

Although FIG. 2 is illustrated and described as utilizing an inductive transmitter 209 that wirelessly transmits power by to an inductive receiver 208 via induction, it should be understood that this is an example. In various implementations, other wireless power delivery systems may be utilized. For example, FIGS. 3-5A show cross-sectional views of additional examples of key stacks that use wireless power delivery systems for illumination in accordance with further embodiments of the present disclosure.

Figure 3:
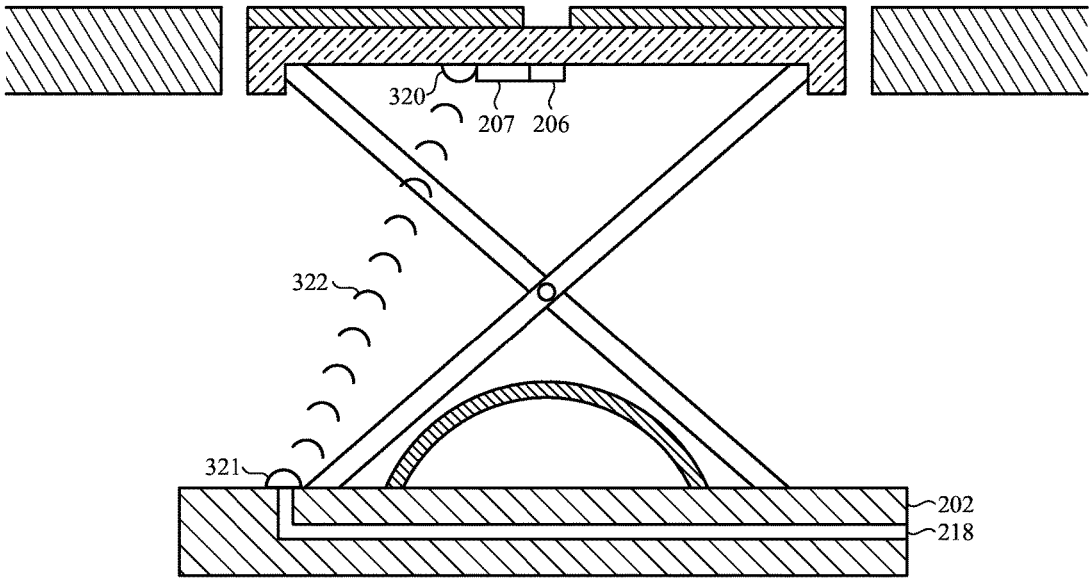

By way of contrast with FIG. 2, FIG. 3 includes an ultrasonic transmitter 321 coupled to the power conduit 218 of the printed circuit board 202. The ultrasonic transmitter 321 may emit an ultrasonic signal 322 using power from the power conduit 218. The ultrasonic signal 322 may be received by an ultrasonic receiver 320, which may convert the received ultrasonic signal 322 to power. The ultrasonic receiver 320 may provide the power from the ultrasonic signal 322 to the storage capacitor 207 and/or the illuminator 206.

Figure 4:
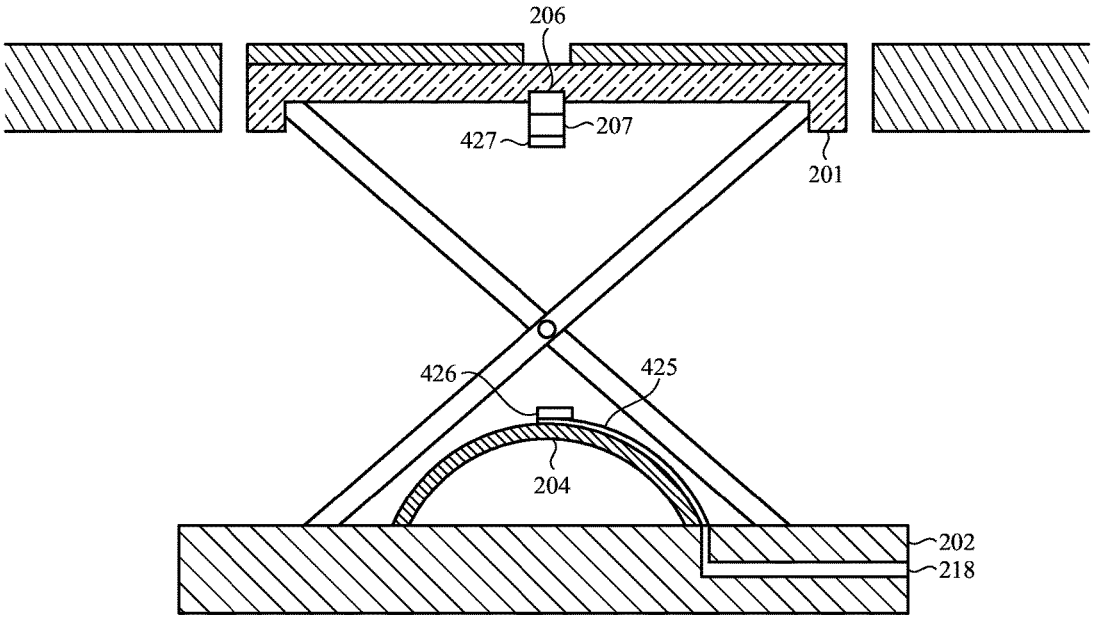

Similarly, FIG. 4 includes a first electrode 427 and a second electrode 426. The first electrode 427 is coupled to the illuminator 206 via the storage capacitor 207. The second electrode 426 is disposed on the dome switch 204 and connected to the power conduit 218 of the printed circuit board 202 via a trace 425. The first electrode 427 may be operative to capacitively couple to the second electrode 426. Particularly as the first electrode 427 moves closer to the second electrode 426, this capacitive coupling may allow the first electrode 427 to receive power from the second electrode 426 that the second electrode 426 receives from the power conduit 218. The first electrode 427 may provide the power from the capacitive coupling to the storage capacitor 207 and/or the illuminator 206.

Further, the illuminator 206 may be partially or fully embedded in the key cap 201 instead of being coupled to a surface. FIG. 4 illustrates the illuminator 206 as partially embedded in the key cap 201.

Figure 5A:
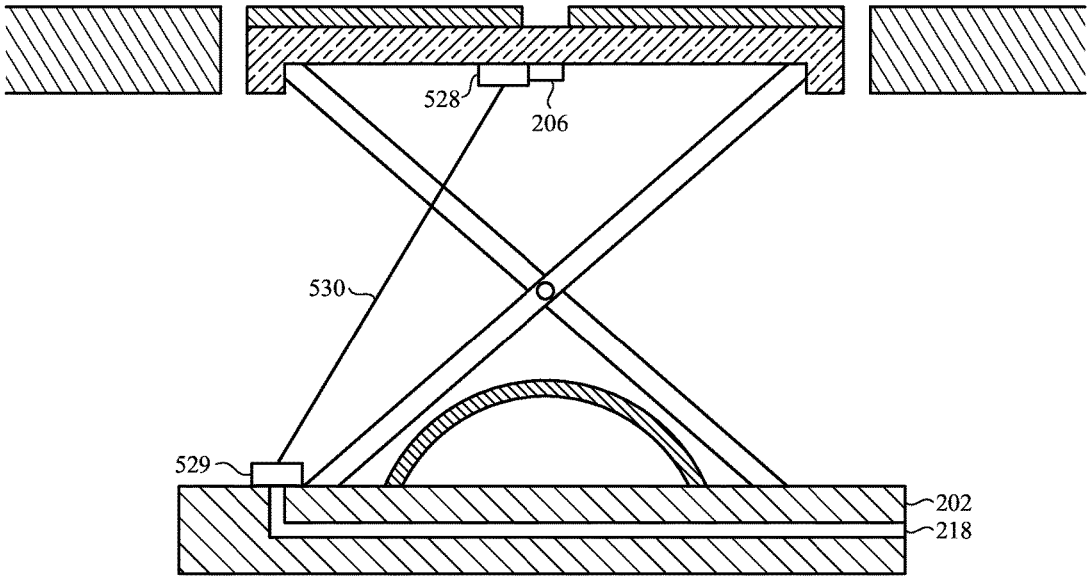
Figure 5B:
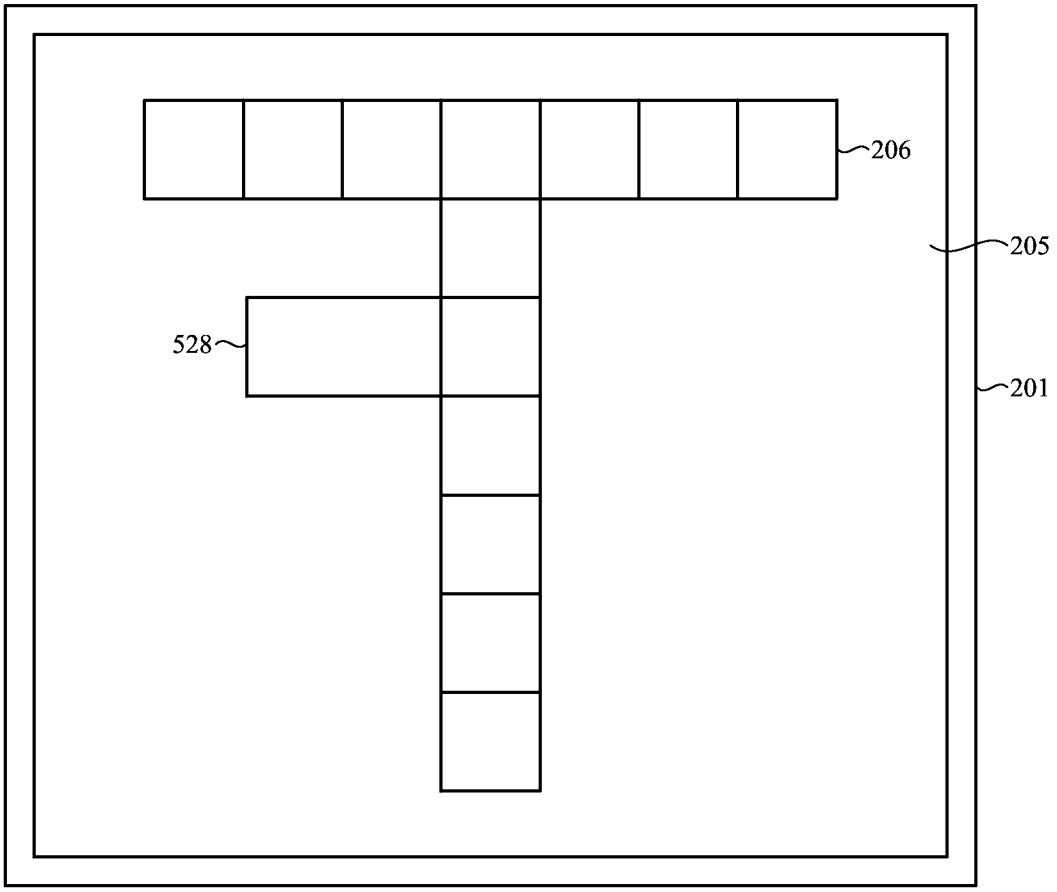
FIG. 5B shows a bottom view of the key cap of FIG. 5A with other components removed for clarity.

Likewise, FIG. 5A includes a photodiode 528 coupled to the illuminator 206 and a laser diode 529 coupled to the power conduit 218 of the printed circuit board 202. The laser diode 529 may emit a laser beam 530 to the photodiode 528 using power from the power conduit 218. The photodiode 528 may convert the received laser beam 530 to power, which the photodiode 528 may provide to the illuminator 206.

Although FIGS. 2-5A illustrate a single illuminator 206, it should be understood that these are examples. In various implementations, multiple illuminators 206 may be used. For example, FIG. 5B shows a bottom view of the key cap 201 of FIG. 5A with other components removed for clarity. As shown, multiple illuminators 206 are coupled to an area the underside surface 205 of the key cap 201 corresponding to the "T" legend of the key. The multiple illuminators 206 may be coupled to each other in order to receive power from one of the illuminators 206 that is coupled to the photodiode 528. However, in some implementations such multiple illuminators 206 may be directly coupled to the photodiode 528, such as via one or more traces on the underside surface 205 of the key cap 201.

Further, although FIGS. 2-5A illustrate particular configurations of components, it should be understood that these are examples and that components may be otherwise arranged without departing from the scope of the present disclosure. For example, in some implementations an inductive transmitter 209 may be coupled to the top plate 103 and connected to a power conduit 218 included therein or thereon. By way of another example, in various implementations an ultrasonic transmitter 321 may be located on the movement mechanism 203. By way of still another example, in some implementations a second electrode 426 may be located on a side of the top plate 103 in a gap defined between the top plate 103 and the key cap 201. In yet another example, in various implementations a laser diode 529 may be located on the printed circuit board 202 and/or beneath the dome switch 204.

Figure 6:
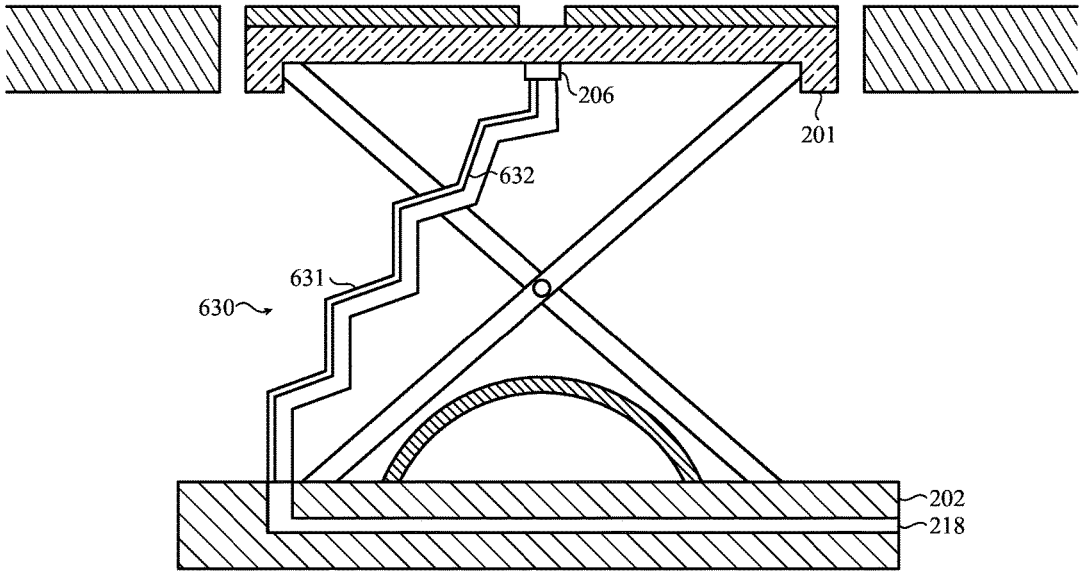
FIG. 6 shows a cross-sectional view of an additional example of a key stack that uses a wired power delivery system for illumination in accordance with further embodiments of the present disclosure.

FIG. 6 shows a cross-sectional view of an additional example of a key stack that uses a wired power delivery system for illumination in accordance with further embodiments of the present disclosure. As contrasted with FIG. 2, an interconnect 630 may be coupled to the illuminator 206 and a power source, such as the power conduit 218 of the printed circuit board 202, that provides power from the power source to the illuminator 206.

Figure 7:
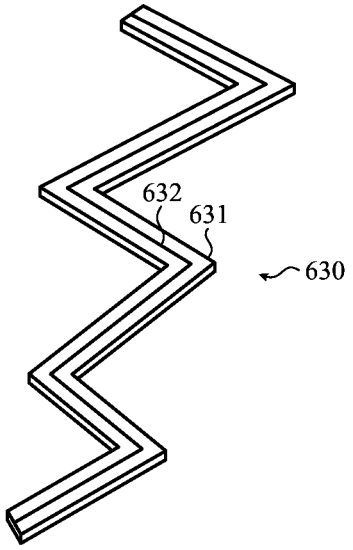
FIGS. 7-8 are side views of example interconnects that may be used in the example key stack of FIG. 6.

The interconnect 630 of the example shown in FIG. 6 may have a flexible material 631 including a trace 632. The flexible material 631 may be flexible, but may not be elastic. In some examples, the flexible material may be formed of a polymer, an elastomer, and/or other such material. The flexible material 631 may be configured with a shape that bends and/or twists when the key cap 201 moves (such as between a depressed and an un-depressed position). For example, the flexible material 631 is illustrated as having a zigzag shape with multiple three-dimensional direction changes along the length of the flexible material 631 extending from the printed circuit board 202 to the illuminator 206. These direction changes may allow the flexible material 631 to bend and/or twist to accommodate movement of the key cap 201 without stretching the flexible material 631. This may prevent or reduce separation of the trace 632 from the flexible material 631 and/or tearing of the trace 632 and/or the flexible material 631. FIG. 7 illustrates a side view of the interconnect 630 alone with other components removed for clarity.

Figure 8:
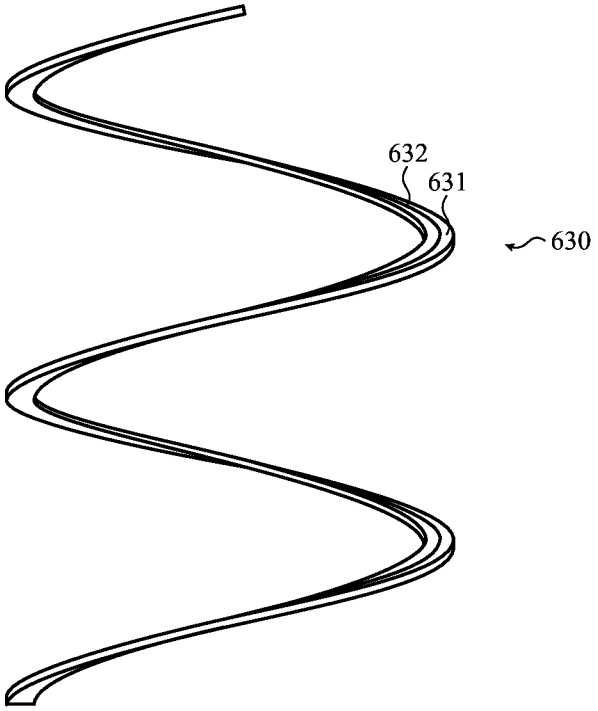

However, although the interconnect 630 is illustrated as being configured with a particular shape, it should be understood that this is an example and that other shapes may be utilized without departing from the scope of the present disclosure. Such shapes may include a zigzag shape, a serpentine shape (which may be similar to a zigzag shape but with curved instead of sharp direction changes), a spiral, and so on. For example, FIG. 8 shows another example interconnect 630 having a flexible material 631 configured with a spiral shape having a trace 632 formed thereon. The spiral shape may allow the flexible material 631 to bend and twist when the flexible material 631 moves.

Additionally, although a particular interconnect 630 is illustrated and described with respect to FIG. 6, it should be understood that this is an example. In various implementations, other interconnects may be utilized without departing from the scope of the present disclosure.

Figure 9:
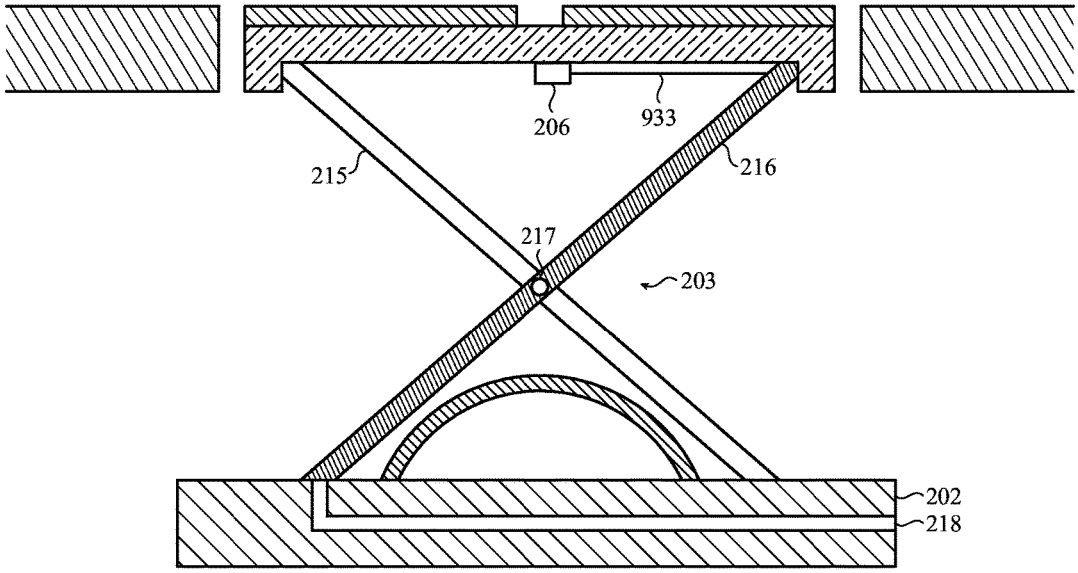
FIGS. 9-10 show cross-sectional views of additional examples of key stacks that use wired power delivery systems for illumination in accordance with further embodiments of the present disclosure.

For example, FIG. 9 illustrates an embodiment that utilizes the movement mechanism 203 as part of the interconnect. The moveable strut 216 of the multiple moveable struts 215 and 216 may be conductive. As such, the conductive moveable strut 216 may be connected to the power conduit 218 of the printed circuit board 202 and to the illuminator 206 via a trace 933.

In further embodiments, the moveable strut 216 may itself be non-conductive but may still function to connect the power conduit 218 and the trace 933. For example, in such embodiments a trace may be formed on the moveable strut 216 that connects the power conduit 218 and the trace 933.

Figure 10:
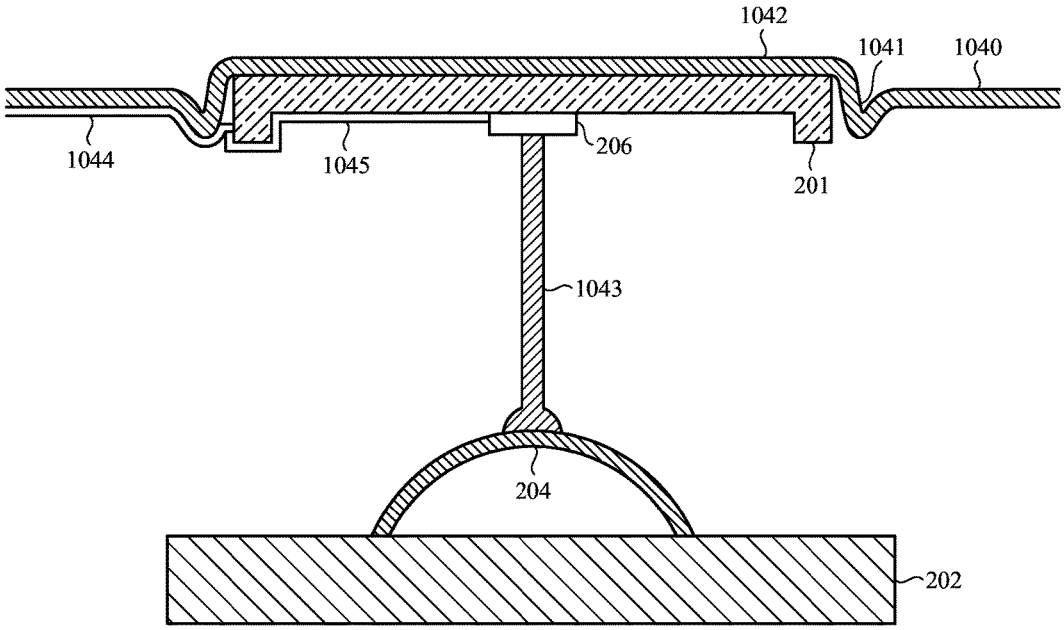

By way of another example, FIG. 10 illustrates an embodiment where a support mechanism for a key cap 201 is a fabric web 1040 instead of the movement mechanism 203 illustrated in FIG. 9. In this example, the key cap 201 may be bonded to an embossed area 1042 of the fabric web 1040 adjacent unbonded bends 1041. The fabric web 1040 may be configured to stretch and/or flex such that the bends 1041 are operable to flex and/or move allow the key cap 201 to transition between an un-depressed (shown) and a depressed position (where a plunger 1043 compressed the dome switch 204 on the printed circuit board 202 or other substrate).

Further in this example, the illuminator 206 may be coupled to a power source that is connected to a trace 1044 formed on the fabric web 1040 via a trace 1045 formed on the key cap 201. However, is it should be understood that this is an example and that other mechanisms of connecting the illuminator 206 to a power source may be utilized, such as implementations where the interconnect 630 of FIG. 7 or 8 is disposed on the fabric web 1040 to connect the illuminator 206 to a power source.

Although FIGS. 1-10 are illustrated and described above in the context of keyboard keys, it is understood that these are examples. In various implementations, one or more of the techniques described herein may be utilized with other actuators or components without departing from the scope of the present disclosure. Any illumination element may be used in and/or with any kind of input device. For example, the techniques illustrated and described herein may be utilized in one or more buttons, such as a button included in the cuff or other portion of an electronic item of apparel.

FIGS. 1-10 are illustrated and described above in the context of illuminating keyboard keys. In some implementations, the illumination may be controlled by a processing unit or the like. In various examples of such implementations, the keys may be illuminated under certain conditions. For example, one or more keys may be illuminated under the control of a processing unit or the like when ambient light sensed by an ambient light sensor falls below a threshold. In other words, if the environment becomes dark the keys may be illuminated. By way of another example, the processing unit or the like may illuminate one or more keys in response to a user input (such as illuminating a key when pressed by a user) or system operating condition (such as illuminating a key when instructed by an application or the operating system; based on change of a system variable such as a power status, storage space, available memory, and so on; and/or other system operating condition).

FIG. 1 illustrates a laptop computing device 100. Such a laptop computing device 100 may include various components, such as processing units, non-transitory storage media, communication components, input/output components, and so on. The processing unit may execute instructions stored in the non-transitory storage media to receive input via the keyboard 101, illuminate keys 102, and/or perform various other actions.

However, it should be understood that this is an example. The techniques described herein may be utilized with any device without departing from the scope of the present disclosure. Such devices may include an external keyboard, a mobile computing device, a digital media player, a smart phone, a cellular phone, a tablet computing device, a desktop computing device, a wearable device, an item of apparel, and so on.

Figure 11:
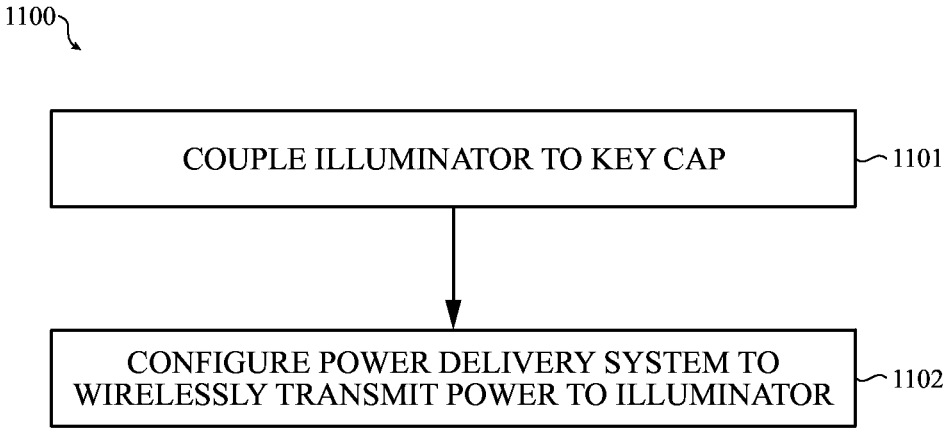
FIG. 11 is a flow chart illustrating a method for assembling an illuminated key for a keyboard. This method may assemble any of the keys of FIGS. 1-5B.

FIG. 11 is a flow chart illustrating a method 1100 for assembling an illuminated key for a keyboard. This method may assemble any of the keys of FIGS. 1-5B.

At 1101, an illuminator may be coupled to a key cap. The illuminator may be an LED (which may be an organic LED) and/or any other device capable of providing illumination. Examples of such devices include lasers, incandescent bulbs, and so on.

At 1102, a power delivery system may be configured to wirelessly transmit power to the illuminator. The power delivery system may be an inductive power transmission system, an ultrasonic power transmission system, a capacitive coupling power transmission system, a laser power transmission system, and/or any other power transmission system capable of wirelessly providing power.

Although the example method 1100 is illustrated and described as including particular operations performed in a particular order, it is understood that this is an example. In various implementations, various orders of the same, similar, and/or different operations may be performed without departing from the scope of the present disclosure.

For example, in some implementations the example method 1100 may include the additional operation of moveably mounting the key cap on a substrate. Such mounting may moveably mount the key cap above a switch on a movement or support mechanism, such as a scissor or butterfly mechanism, a fabric web, and so on.

Figure 12:
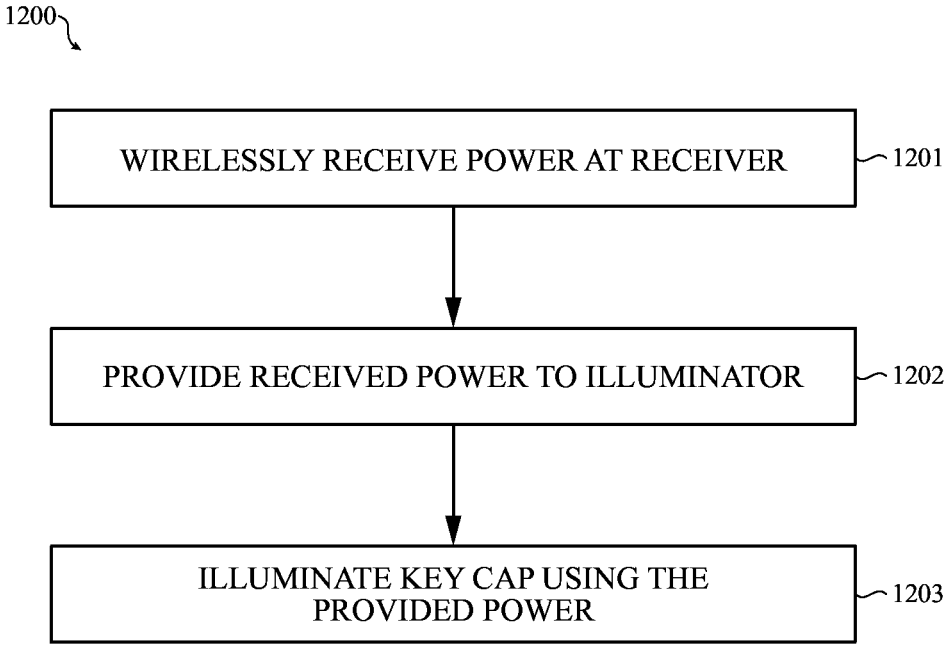
FIG. 12 is a flow chart illustrating a method for wirelessly illuminating keys. This method may be performed using any of the keys of FIGS. 1-5B.

FIG. 12 is a flow chart illustrating a method 1200 for wirelessly illuminating keys. This method may be performed using any of the keys of FIGS. 1-5B.

At 1201, power may be wirelessly received at a receiver that is connected to an illuminator coupled to a key cap. The power may be received using induction, ultrasonic signals, light, capacitive coupling, and so on.

At 1202, the received power may be provided to the illuminator. The received power may be provided directly and/or via a storage or other component such as a capacitor.

At 1203, the key cap may be illuminated using the provided power. The key cap may be continually illuminated during operation or may be illuminated in response to particular events. For example, in some implementations the key cap may be illuminated when activated to indicate activation.

Although the example method 1200 is illustrated and described as including particular operations performed in a particular order, it is understood that this is an example. In various implementations, various orders of the same, similar, and/or different operations may be performed without departing from the scope of the present disclosure.

For example, in various implementations the example method 1200 may include the additional operation of wirelessly transmitting the power from a transmitter to the receiver. By way of another example, in some implementations the example method 1200 may include the additional operation of storing the received power. In such implementations, the power provided in 1202 may be the stored power.

As described above and illustrated in the accompanying figures, the present disclosure relates to surface illumination. One or more illuminators may be coupled to the key cap of a key. Additionally, a key cap may include a portion that is operable to be illuminated and one or more illuminators may be coupled to that portion. These techniques may enable distribution of illumination without light guides and/or other structures and may prevent other key stack structures from interfering with light distribution. In particular embodiments, key stacks may include power delivery systems that are operable to wirelessly transmit power from a power source to illuminators coupled to the key caps. Such power delivery systems can include inductive transmitters and/or receivers, ultrasonic transmitters and/or receivers, laser diodes and photodiodes, electrodes that capacitively couple to wirelessly transfer power, and so on. In various embodiments, key stacks of keys may include interconnects that connect illuminator coupled to the key caps with power sources. In some implementations, the interconnect may be a flexible material that includes one or more traces and is configured with a shape that bends and twists to allow movement of the key cap without stretching. In various implementations, the interconnect may be part of a movement or support mechanism of a key, such as where a support mechanism includes a conductive moveable strut that connects the illuminator and power source or where the support mechanism is a fabric web in which the key cap is mounted and the interconnect is one or more traces disposed thereon.

In the present disclosure, the methods disclosed may be implemented as sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may utilize a computer program product, or software, that may include a non-transitory machine-readable medium having stored thereon instructions, which may be used to program a computer system (or other electronic devices) to perform a process according to the present disclosure. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A keyboard, comprising:

a printed circuit board;

a number of keys coupled to the printed circuit board, each key comprising:

an actuator;

a movement mechanism coupled to the actuator that biases the actuator towards an un-depressed position and allows movement of the actuator towards a depressed position to activate the respective key;

a light emitting diode coupled to the actuator; and a power receiver coupled to the light emitting diode that is operable to provide power wirelessly received from the printed circuit board to the light emitting diode.

2. The keyboard of claim 1, wherein the power receiver comprises at least one of an inductive receiver, an ultrasonic receiver, a photodiode, or a first electrode that wirelessly receives power by capacitively coupling to a second electrode.

3. The keyboard of claim 1, wherein:

the actuator includes a first region that is operable to be illuminated and a second region that is not operable to be illuminated; and the light emitting diode is coupled to the first region.

4. The keyboard of claim 3, wherein the light emitting diode comprises multiple light emitting diodes coupled to the first region.

5. A key stack, comprising:

a substrate having a switch and a power conduit;

a key cap disposed above the switch;

a support mechanism moveably coupling the key cap to the substrate and configured to move the key cap into a depressed position to actuate the switch;

an illuminator coupled to the key cap; and a power delivery system operable to wirelessly transmit power from the power conduit to the illuminator.

6. The key stack of claim 5, wherein the power delivery system comprises an inductive receiver coupled to the illuminator and operable to inductively receive power from an inductive transmitter.

7. The key stack of claim 5, wherein the power delivery system comprises a first electrode coupled to the illuminator and operable to capacitively couple to a second electrode to wirelessly receive power from the second electrode.

8. The key stack of claim 5, wherein the power delivery system comprises an ultrasonic receiver coupled to the illuminator and operable to convert an ultrasonic signal received from an ultrasonic transmitter into power for the illuminator.

9. The key stack of claim 5, wherein the power delivery system comprises a photodiode coupled to the illuminator and configured to convert light received from a laser diode into power for the illuminator.

10. The key stack of claim 5, further comprising a storage capacitor coupled to the illuminator that is operable to store power received from the power delivery system and provide stored power to the illuminator.

11. The key stack of claim 5, wherein the illuminator is at least one of:

coupled to a surface of the key cap; or embedded at least partially within the key cap.

12. The key stack of claim 5, wherein the illuminator is at least one of a light emitting diode or an organic light emitting diode.

13. A key stack, comprising:

a key cap;

a support mechanism coupled to the key cap that allows movement of the key cap and comprises a fabric web having an underside to which the key cap is bonded;

an illuminator coupled to the key cap; and a conductive interconnect in or on the fabric web; wherein:

the conductive interconnect is coupled to the illuminator and a power source that provides power from the power source to the illuminator.

14. The key stack of claim 13, wherein the conductive interconnect comprises a conductive trace.

15. The key stack of claim 13, wherein the conductive interconnect comprises a trace formed on the fabric web.

16. The key stack of claim 13, wherein:

the key cap includes a transparent region and an opaque region; and the illuminator is coupled to the transparent region.

17. The key stack of claim 13, wherein the fabric web comprises an embossed area bounded by a set of bends, and the key cap is bonded to the embossed area.

* * * * *